US011028495B2

(12) United States Patent
Chun et al.

(10) Patent No.: US 11,028,495 B2
(45) Date of Patent: Jun. 8, 2021

(54) METHOD FOR PRODUCING POROUS COPPER FOIL AND POROUS COPPER FOIL PRODUCED BY THE SAME

(71) Applicant: YMT CO., LTD., Icheon (KR)

(72) Inventors: Sung Wook Chun, Incheon (KR); Ik Beom Kim, Incheon (KR); Seon Gi Jeon, Ansan-si (KR); Dae Hoon Lee, Anyang-si (KR); Youn Bong Kang, Incheon (KR); Jun Mo Hong, Ansan-si (KR); Hyeong Gyu Park, Ansan-si (KR)

(73) Assignee: YMT CO., LTD., Incheon (KR)

( * ) Notice: Subject to any disclaimer, the term of this patent is extended or adjusted under 35 U.S.C. 154(b) by 80 days.

(21) Appl. No.: 15/924,215

(22) Filed: Mar. 18, 2018

(65) Prior Publication Data

US 2018/0282890 A1 Oct. 4, 2018

(30) Foreign Application Priority Data

Mar. 30, 2017 (KR) ..... 10-2017-0040600

(51) Int. Cl.

| | |
|---|---|
| ***C25D 1/08*** | (2006.01) |
| ***C23C 18/16*** | (2006.01) |
| ***C25D 3/38*** | (2006.01) |
| ***C23C 18/38*** | (2006.01) |
| ***C23F 17/00*** | (2006.01) |
| ***C25D 1/04*** | (2006.01) |
| ***C25D 1/20*** | (2006.01) |
| ***C23C 18/54*** | (2006.01) |

(52) U.S. Cl.

CPC ..... *C25D 1/08* (2013.01); *C23C 18/1646* (2013.01); *C23C 18/1651* (2013.01); *C23C 18/1653* (2013.01); *C23C 18/1657* (2013.01); *C23C 18/38* (2013.01); *C23C 18/54* (2013.01); *C23F 17/00* (2013.01); *C25D 1/04* (2013.01); *C25D 1/20* (2013.01); *C25D 3/38* (2013.01)

(58) Field of Classification Search

CPC ... C25D 1/08; C25D 1/04; C25D 1/20; C25D 3/38; C23C 18/1651; C23C 18/1653; C23C 18/1646; C23C 18/54; C23C 18/1657; C23C 18/38; C23C 18/1637; C23C 18/18; C23C 28/023; C23F 17/00

See application file for complete search history.

(56) References Cited

U.S. PATENT DOCUMENTS

2012/0111733 A1* 5/2012 Tsai ..... H01M 4/661 205/350
2014/0335411 A1* 11/2014 Liu ..... C23C 18/1651 429/218.1

FOREIGN PATENT DOCUMENTS

| | | | |
|---|---|---|---|
| JP | 3370624 | B2 | 1/2003 |
| JP | 2010132959 | A | 6/2010 |
| JP | 5851552 | B2 | 2/2016 |
| KR | 100797691 | B1 | 1/2008 |
| KR | 1020130132356 | A | 12/2013 |

(Continued)

*Primary Examiner* — Louis J Rufo
(74) *Attorney, Agent, or Firm* — STIP Law Group, LLC

(57) ABSTRACT

Provided is a method for producing a porous copper foil. The method includes forming a release layer on a metal carrier, growing copper islands on the metal carrier formed with the release layer by electroless copper plating, forming a porous copper thin layer by copper electroplating, and peeling off the porous copper thin layer from the release layer.

3 Claims, 5 Drawing Sheets

(56) References Cited

FOREIGN PATENT DOCUMENTS

| | | | |
|---|---|---|---|
| KR | 101422262 | B1 | 7/2014 |
| KR | 1020140111975 | A | 9/2014 |
| KR | 101759288 | B1 | 7/2017 |
| TW | 402644 | B | 8/2000 |
| TW | I417424 | B | 12/2013 |

* cited by examiner

METHOD FOR PRODUCING POROUS COPPER FOIL AND POROUS COPPER FOIL PRODUCED BY THE SAME

CROSS-REFERENCE TO RELATED APPLICATIONS

This application claims the priority of the Korean Patent Application No. 10-2017-0040600 filed on Mar. 30, 2017, in the Korean Intellectual Property Office, the disclosure of which is incorporated herein by reference.

BACKGROUND OF THE INVENTION

1. Field of the Invention

The present invention relates to a method for producing a porous copper foil and a porous copper foil produced by the same. More specifically, the present invention relates to a method for producing a copper foil by forming a copper film on a metal carrier and peeling off the copper film, and a porous copper foil produced by the method.

2. Description of the Related Art

Copper foils are widely used as conductive pattern materials, electromagnetic shielding materials, and heat dissipating materials of printed circuit boards. Copper foils are produced by various processes, for example, rolling and electroplating. With the recent trend toward the miniaturization of electronic devices, there has been a demand for finer patterns that require copper foils with smaller thicknesses.

Copper foils which are prepared using metal carriers are formed on and peeled off from metal carriers. An example of the prior art associated with the production of ultrathin copper foils is described in Korean Patent No. 101422262 already filed and issued to the inventors of the present application. This patent publication discloses a method for producing a substrate formed with a copper thin layer, including providing a carrier, forming a separation-inducing layer on the surface of the carrier, forming the copper thin layer on the separation-inducing layer, and bonding a core to the copper thin layer. On the other hand, a resin bonded with an ultrathin copper foil can be used as a material for a base layer in the manufacture of a printed circuit board. The ultrathin copper foil uses another copper foil having a thickness of about 18 μm as a carrier. The ultrathin carrier copper foil is obtained by forming a metal layer, such as a nickel alloy layer, on the carrier by sputtering and then electroplating the metal layer. Thereafter, the ultrathin carrier copper foil is transferred to the resin before use. However, the ultrathin carrier copper foil produced by this process is expensive because it uses a thick copper foil as a carrier. There is another disadvantage in that the metal component of the sputtering which is performed as a pretreatment for electroplating remains and are difficult to remove after patterning.

Copper foils having surface and internal pores are expected to be very effective in shielding electromagnetic waves and dissipating heat considering their application to electromagnetic shielding and heat dissipating devices. These effects are attributed to an increase in the surface area of the copper foils. That is, the increased surface area improves the ability of the copper foils to absorb electromagnetic waves or dissipate internal heat to the outside.

SUMMARY OF THE INVENTION

The present invention has been made in view of the problems of the prior art, and it is a first object of the present invention to provide a method for producing a porous copper foil whose porosity is easy to control by sequentially applying electroless copper plating and copper electroplating to form a porous copper thin layer on a metal carrier and peeling off the porous copper thin layer.

It is a second object of the present invention to provide a porous copper foil produced by the method.

It is a third object of the present invention to provide a method for manufacturing a polymer resin sheet with surface irregularities based on the production method.

A first aspect of the present invention provides a method for producing a porous copper foil, including: forming a release layer on a metal carrier; growing copper islands on the metal carrier formed with the release layer by electroless copper plating; forming a porous copper thin layer by copper electroplating; and peeling off the porous copper thin layer from the release layer.

According to one embodiment of the present invention, the metal carrier may be made of aluminum and may have a natural surface oxide film.

According to a further embodiment of the present invention, the porous copper thin layer preferably has a thickness of 1 to 5 microns and includes pores having a size of 1 to 30 microns.

According to another embodiment of the present invention, the release layer is preferably a metal compound layer having a thickness of 10 nanometers or less.

A second aspect of the present invention provides a porous copper foil including a porous copper thin layer formed by copper electroplating and electroless plated copper particles discontinuously attached to the bottom of the porous copper thin layer.

A third aspect of the present invention provides a method for manufacturing a polymer resin sheet with surface irregularities, including: forming a release layer on a metal carrier; growing copper islands on the metal carrier formed with the release layer by electroless copper plating; forming a porous copper thin layer by copper electroplating; applying a curable polymer onto the porous copper thin layer and curing the curable polymer; peeling off the cured polymer and the porous copper thin layer from the release layer; and removing the copper from the cured polymer and the porous copper thin layer.

The method for producing a porous copper foil according to the present invention possesses the following effects.

1. The method enables the production of a porous copper foil that is easy to peel off from a metal carrier by sequential application of electroless copper plating and copper electroplating. Therefore, according to the method, a porous copper foil can be produced in a simple manner.

2. Process parameters associated with the formation of island-like copper particles by electroless copper plating and process parameters associated with the copper electroplating rate can be individually controlled, facilitating control over the thickness, porosity, and the pore size of a porous copper foil.

3. A polymer sheet with fine surface micropores can be manufactured based on the method. Specifically, the polymer sheet is manufactured by applying a curable polymer onto a porous copper thin layer formed by the method, curing the curable polymer, and removing the copper thin layer. The polymer sheet can be utilized as a resin material with good plating adhesion and high adhesive strength to other materials.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE INVENTION

Figure 1:
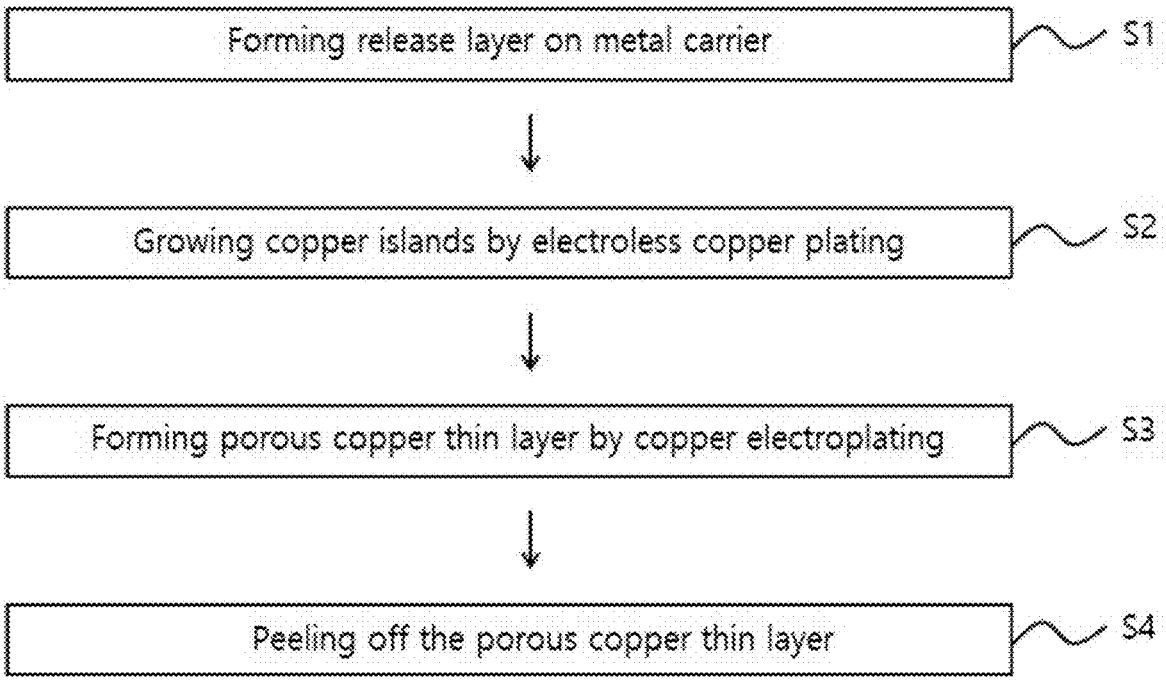
FIG. 1 is a flow chart illustrating a method for producing a porous copper foil using a metal carrier according to one embodiment of the present invention.

A method for producing a porous copper foil according to the present invention includes: forming a release layer on a metal carrier; growing copper islands on the metal carrier formed with the release layer by electroless copper plating; forming a porous copper thin layer by copper electroplating; and peeling off the porous copper thin layer from the release layer.

According to the method of the present invention, a release layer is formed on a metal carrier and electroless copper plating and copper electroplating are sequentially performed to form a porous copper thin layer on the release layer. The porous copper thin layer can be easily peeled off from the release layer, enabling the production of a thin porous copper foil in a simple manner.

The method of the present invention includes some features in the production of a porous copper foil. The first feature is a very small thickness of the release layer. The release layer formed on the metal carrier is a compound layer including a metal element, such as nickel or cobalt. The release layer may have a thickness ranging from 5 to 10 nanometers. Within this range, the release layer becomes conductive due to the tunneling effect, enabling the application of a voltage to electroless plated copper particles during copper electroplating using the metal carrier as an electrode. The second feature is the formation of island-like plated copper particles by electroless copper plating. The plated copper particles are formed on the release layer or portions of the surface of the metal carrier on which the release layer is not formed. The electroless plating time is adjusted such that copper particles are formed, specifically the electroless copper plating is stopped before a uniform layer is formed. The third feature is to perform copper electroplating using the metal carrier, as an electrode, on which the release layer and the plated copper particles are formed. Copper plating does not occur on the release layer or the metal carrier during copper electroplating because the metal carrier is made of aluminum. The surface of aluminum is not plated during electroplating because a natural oxide film is formed on aluminum in air. Plating does not occur even on the release layer composed of a nickel or cobalt oxide/nitride with very low electrical conductivity instead of a pure metal. Only the plated copper particles formed by electroless copper plating are plated during copper electroplating. The electroplated copper formed on the plated copper particles separated from one another meets the electroplated copper formed on the adjacent plated copper particles to form a porous copper thin layer. The physical properties of the porous copper thin layer are affected by the electroless copper plating conditions and the copper electroplating conditions. The pore size of the porous copper thin layer is affected mainly by the electroless copper plating conditions. A short set electroless copper plating time leads to the formation of relatively large pores. In contrast, a long set electroless copper plating time leads to the formation of relatively small pores. The pore size (diameter) of the porous copper thin layer is preferably in the range of 1 to 30 microns, more preferably 5 to 20 microns. If the pore size of the copper thin layer is smaller than 1 micron, it is difficult to control the porosity of a final porous copper foil. Meanwhile, if the pore size of the copper thin layer exceeds 30 microns, the strength of a final copper foil is excessively lowered. The pore size is determined by observing the surface of the copper thin layer. Thus, although the thickness of the copper thin layer is observed to be smaller than the size of surface pores, the actual pore size may have a value larger than the size of surface pores.

The method of the present invention can be applied to the manufacture of a polymer resin sheet with surface irregularities. Specifically, a curable polymer is applied onto the porous copper thin layer formed by the method and is cured, and the porous copper thin layer is peeled off from a release layer to manufacture a polymer resin sheet attached with the porous copper thin layer. Then, the porous copper thin layer is etched to form pores at positions from which the copper is removed. The pores make the surface of the polymer resin sheet irregular.

The present invention will now be described in detail with reference to the accompanying drawings.

FIG. 1 is a flow chart illustrating a method for producing a porous copper foil using a metal carrier according to one embodiment of the present invention.

Referring to FIG. 1, first, a release layer is formed on a metal carrier (S1). The metal carrier is preferably made of aluminum. The use of aluminum prevents the deposition of copper during subsequent copper electroplating because a natural oxide film is formed on the aluminum surface. For this reason, a porous copper thin layer can be formed by copper electroplating. The release layer may be formed of a metal compound, specifically a nickel or cobalt compound. The release layer may be formed in an electroless manner. Specifically, the release layer is formed by degreasing the aluminum carrier and depositing the degreased aluminum carrier in a solution composed of 10 to 100 g/L (more preferably 30 to 60 g/L) of nickel chloride, 10 to 50 g/L (more preferably 20 to 30 g/L) of cobalt chloride, 100 to 200 g/L (more preferably 130 to 160 g/L) of calcium chloride, less than 500 ppm of a PEG surfactant, and less than 10 ppm of an iron compound as a reducing agent at 30 to 50° C. for 2 to 3 minutes. The release layer may have a thickness of 1 to 10 nm (more preferably 3 to 7 nm).

Subsequently, island-like copper particles are allowed to grow on the metal carrier formed with the release layer by electroless copper plating (S2). The electroless plating time is adjusted such that the electroless copper plating is stopped in a state in which island-like copper particles are grown before a uniform layer is formed. The electroless copper plating can be performed by depositing the aluminum carrier formed with the release layer in a solution composed of 50 to 100 g/L (more preferably 70 to 80 g/L) of a copper salt, 70 to 150 g/L (more preferably 90 to 120 g/L) of a complexing agent, and a pH-adjusting agent (such as sodium hydroxide or potassium hydroxide) at a temperature of 30 to 50° C. for 30 seconds to 2 minutes.

Subsequently, a porous copper thin layer is formed by copper electroplating (S3). Copper electroplating does not occur on the aluminum carrier and the release layer, and copper is plated only on the surface of the copper particles formed by electroless copper plating. The plated copper meets the plated copper grown on the adjacent copper particles to form a porous copper thin layer. The copper electroplating conditions are preferably adjusted such that the porous copper thin layer has a thickness of 1 to 5 microns. If the thickness of the copper thin layer is smaller than 1 micron, the strength of a final copper foil is excessively lowered and the applicability of a final copper foil is not extended. Meanwhile, if the thickness of the copper thin layer exceeds 5 microns, the advantages of an ultrathin copper foil cannot be expected.

A solution composed of 100 to 150 g/L (more preferably 120 to 130 g/L) of copper sulfate, 100 to 150 g/L (more preferably 120 to 130 g/L) of sulfuric acid, less than 50 ppm of hydrochloric acid, and additives such as a glazing agent and a leveler, is used for the copper electroplating. The copper electroplating is performed at a current density of 1.4 ASD and at room temperature. The copper electroplating results in the formation of an ultrathin (~3 microporous copper layer. The mean size of the pores in the ultrathin copper layer varies depending on the electroless copper plating time. The mean pore size is in the range of 25 to 30 μm when the electroless copper plating is performed for 30 seconds. The mean pore size is in the range of 8 to 15 μm when the electroless copper plating is performed for 1 minute. The mean pore size is in the range of 1 to 5 μm when the electroless copper plating is performed for 2 minutes.

Finally, the porous copper thin layer is peeled off from the release layer to form a porous copper foil. For use as an electromagnetic shielding/absorbing or heat dissipating material, the porous copper foil is laminated to a conductive epoxy/polyester resin and the aluminum carrier is then peeled off.

Figure 2:
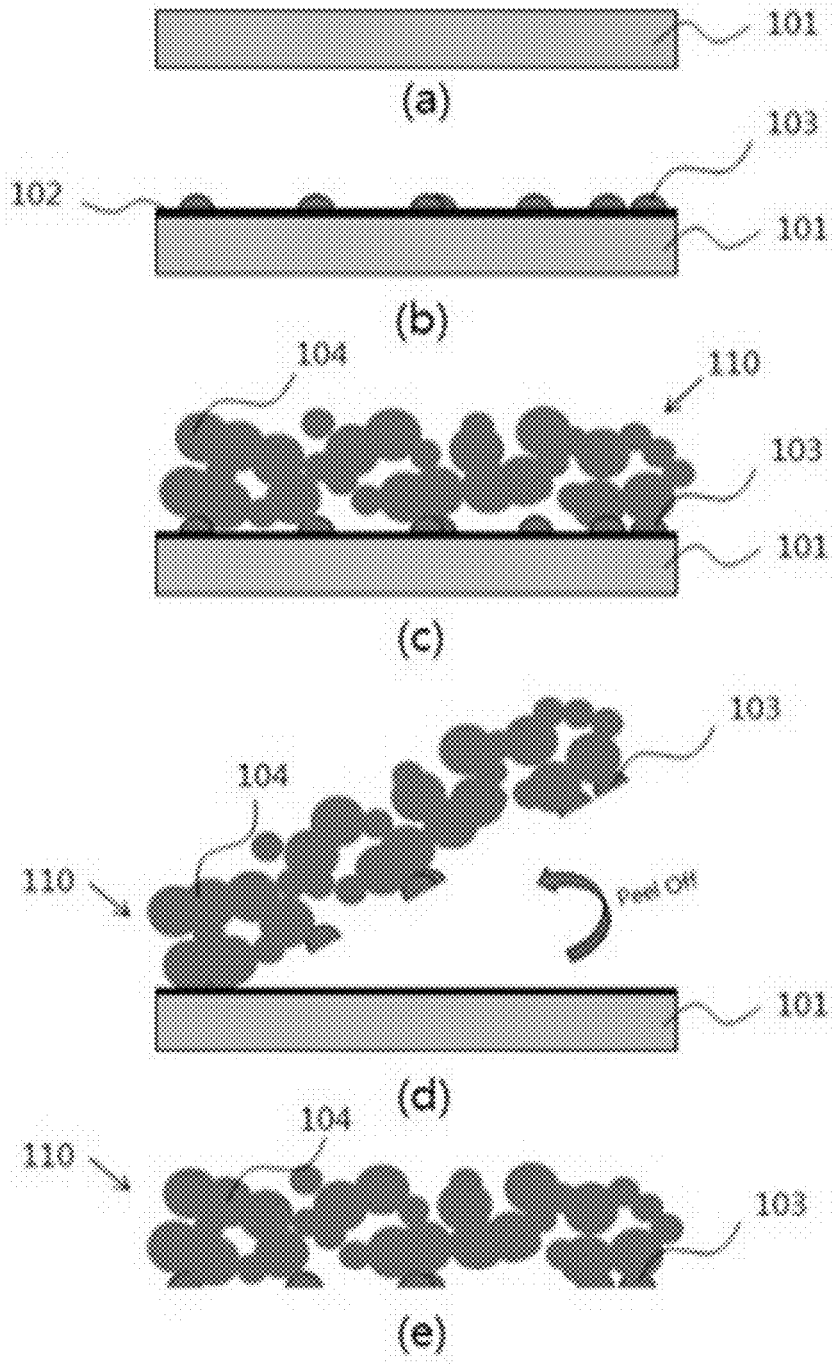
FIG. 2 illustrates the cross-sections of structures obtained in the individual steps of the method illustrated in FIG. 1.

FIG. 2 illustrates the cross-sections of structures obtained in the individual steps of the method illustrated in FIG. 1. Referring to (a) and (b) of FIG. 2, a release layer 102 is formed on a metal carrier 101 and island-like electroless plated copper particles 103 are formed on the release layer 101. Referring to (c) of FIG. 2, copper grown on the electroless plated copper particles 103 meets copper grown on the adjacent plated copper particles to form a porous copper thin layer 110. Referring to (d) and (e) of FIG. 2, the porous copper thin layer 110 is peeled off from the release layer 102.

Figure 3:
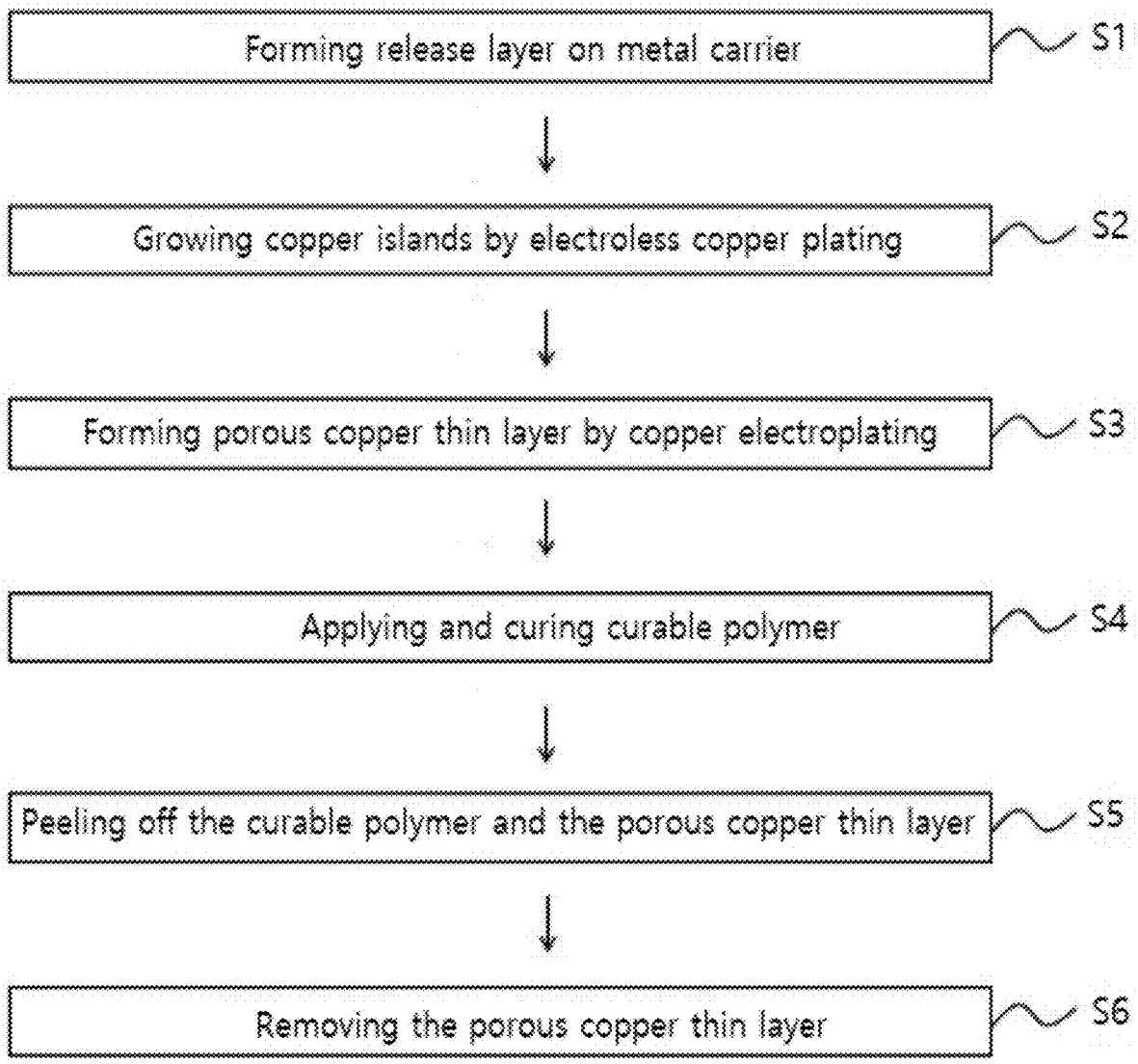
FIG. 3 is a flow chart illustrating a method for manufacturing a polymer sheet with surface irregularities using a porous copper foil according to a further embodiment of the present invention.

FIG. 3 is a flow chart illustrating a method for manufacturing a polymer sheet with surface irregularities using a porous copper foil according to a further embodiment of the present invention. The formation of a release layer on a metal carrier (S1), the growth of copper particles by electroless copper plating (S2), and the formation of a porous copper thin layer by copper electroplating (S3) are the same as those explained in FIG. 1. Subsequently, a curable polymer is applied onto the metal carrier formed with the porous copper thin layer, followed by curing (S4). The curable polymer may be applied by any suitable technique, such as dip coating, spin coating or printing. The curable polymer may be a heat-curable or photocurable polymer. Subsequently, the cured polymer and the porous copper thin layer are peeled off from the release layer (S5). Finally, the porous copper thin layer is removed from the cured polymer resin using a copper etchant (S6).

Figure 4:
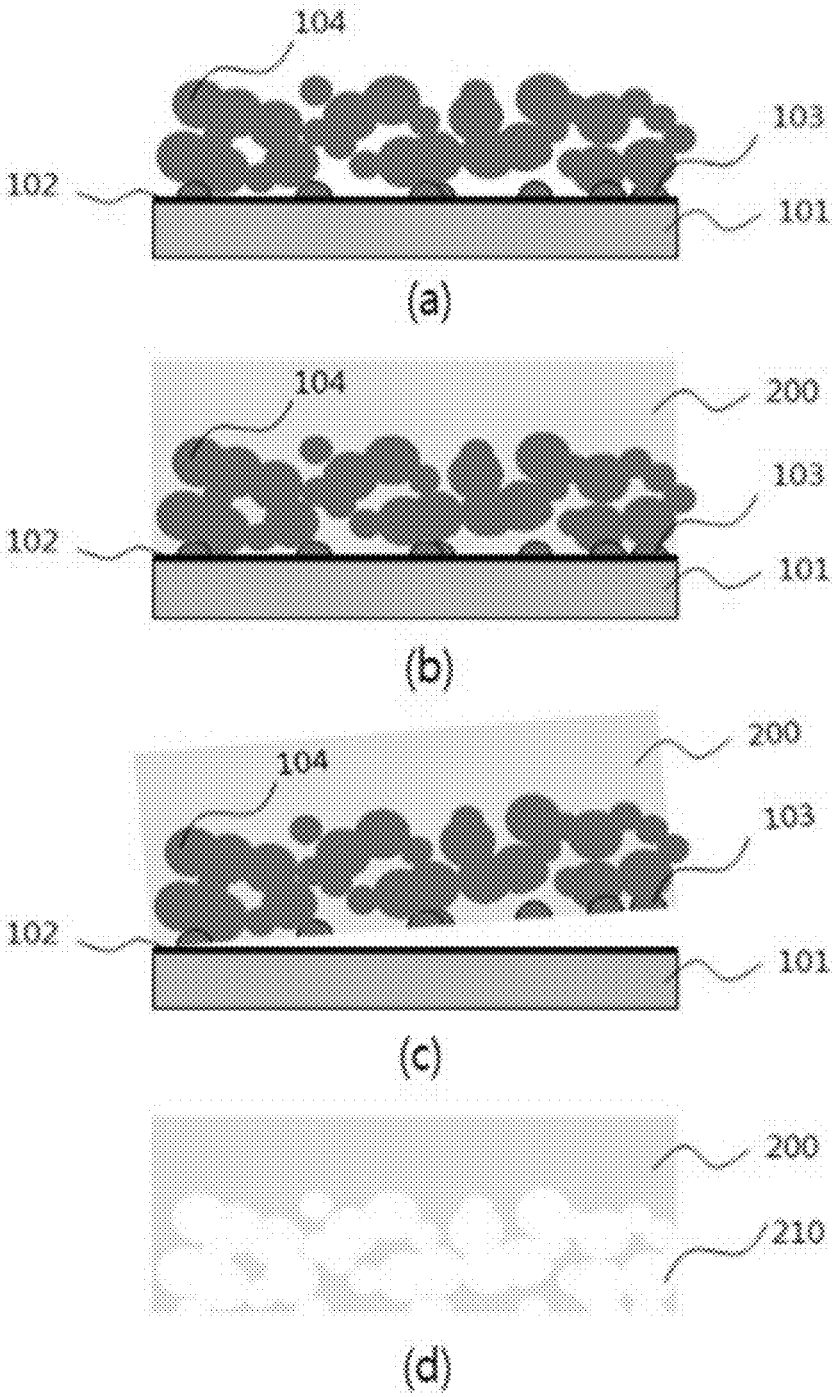
FIG. 4 illustrates the cross-sections of structures obtained in the individual steps of the method illustrated in FIG. 3.

FIG. 4 illustrates the cross-sections of structures obtained in the individual steps of the method illustrated in FIG. 3. Referring to (a) of FIG. 4, a release layer 102 is formed on a metal carrier 101 and a porous copper film consisting of electroless plated copper particles 103 and electroplated copper 104 is formed on the release layer. Referring to (b) of FIG. 4, a curable polymer resin 200 is applied onto the porous copper film. The polymer resin 200 penetrates of the porous copper film to reach the internal pores. Referring to (c) and (d) of FIG. 4, the polymer resin 200 formed with the porous copper film is peeled off from the release layer and the porous copper film is removed by etching to form a porous layer under the polymer resin, completing the manufacture of a polymer sheet with surface irregularities such as concave surfaces.

Figure 5:
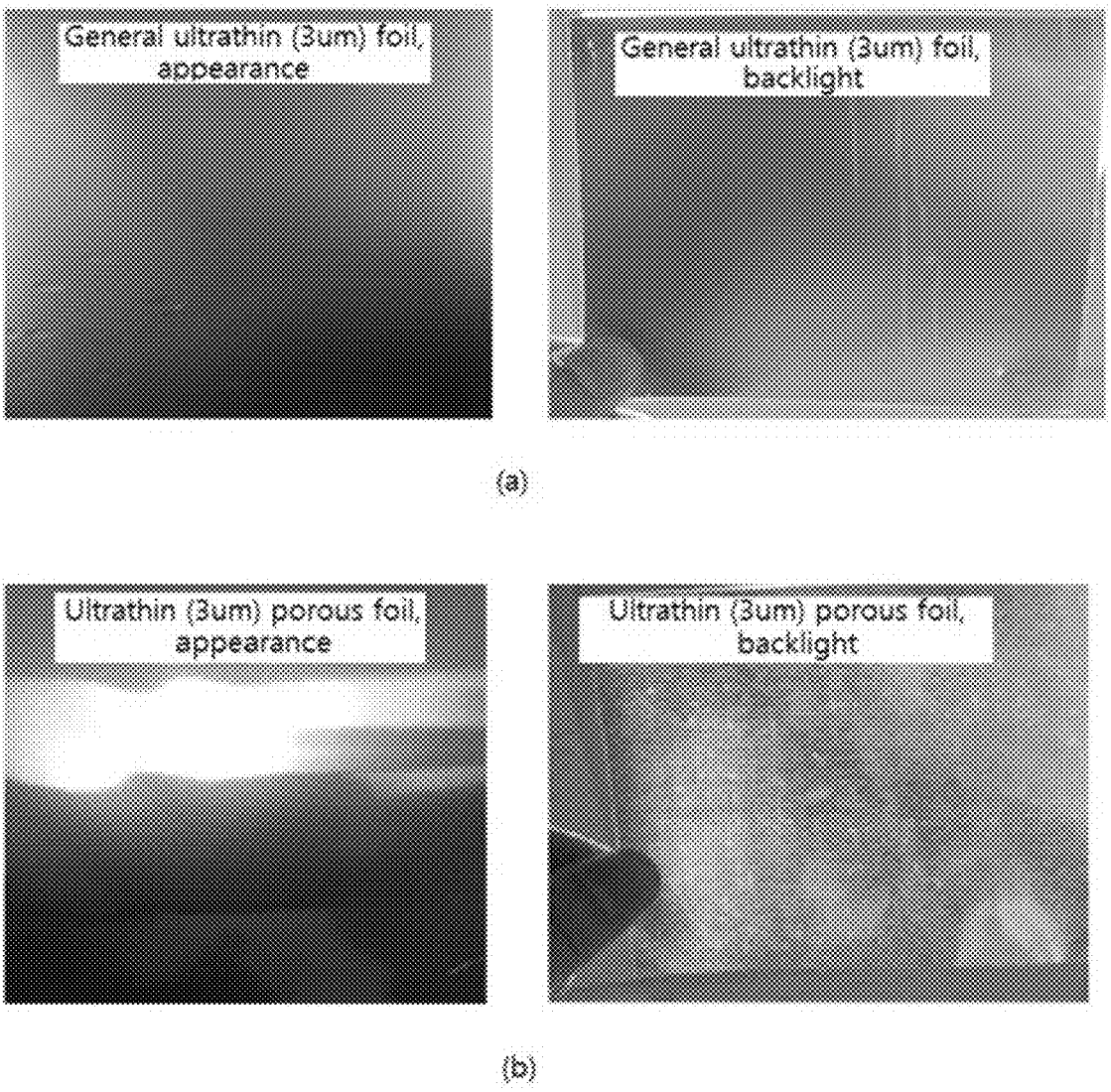
FIG. 5 shows surface images of a porous copper foil produced by a method of the present invention.

FIG. 5 shows surface images of a porous copper foil produced by the method of the present invention. The surfaces of a non-porous copper foil produced by a general method and a porous copper foil produced by the method of the present invention were observed with naked eyes, and as a result, the porous copper foil was found to reflect light by its rough surface.

The present invention will be explained in more detail with reference to the following examples.

Example 1-1 (Production of Porous Copper Foil)

(1) Surface Degreasing of Metal Carrier

An aluminum carrier was degreased with a dilution of a degreasing agent (Al clean 193, YMT) at 30-50° C. for 2-5 min to effectively remove contaminants, including organic matter, from the surface thereof.

(2) Formation of Release Layer

A release layer was formed in an electroless manner. Specifically, the degreased aluminum carrier was deposited in a solution composed of 45 g/L of nickel chloride, 25 g/L of cobalt chloride, 150 g/L of calcium chloride, <50 ppm of a PEG surfactant, <10 ppm of an iron compound as a reducing agent at 40° C. for 2 min to form a ~5 nm thick release layer.

(3) Formation of Electroless Plated Copper Particles

The aluminum carrier formed with the release layer was subjected to electroless copper plating by depositing in a solution composed of 75 g/L of a copper salt, 110 g/L of a complexing agent, and sodium hydroxide or potassium hydroxide as a pH-adjusting agent at 40° C. for 30 sec to form copper islands.

(4) Copper Electroplating

The copper islands formed by electroless copper plating were subjected to copper electroplating. A solution composed of 125 g/L of copper sulfate, 125 g/L of sulfuric acid, <50 ppm of hydrochloric acid, and additives such as a glazing agent and a leveler was used for the copper electroplating. The copper electroplating was performed at a current density of 1.4 ASD and at room temperature. As a result of the copper electroplating, an ultrathin (~3 microporous copper layer was formed. The mean size of the pores in the ultrathin copper layer was about 25-30 μm.

(5) Peeling Off and Application of the Porous Copper Thin Layer

The porous copper thin layer was separated from the release layer to form a porous copper foil. For use as an electromagnetic shielding/absorbing or heat dissipating material, the porous copper foil was laminated to a conductive epoxy/polyester resin and the aluminum carrier was then peeled off.

Example 1-2 (Production of Porous Copper Foil)

A porous copper foil was produced in the same manner as in Example 1-1, except that the electroless plating time was adjusted to 1 min to form electroless plated copper particles. The mean size of the pores in the ultrathin porous copper layer was 8-15 μm.

Example 1-3 (Production of Porous Copper Foil)

A porous copper foil was produced in the same manner as in Example 1-1, except that the electroless plating time was adjusted to 2 min to form electroless plated copper particles. The mean size of the pores in the ultrathin porous copper layer was 1-5 μm.

Example 2 (Manufacture of Polymer Sheet Formed with Irregularities)

The surface of a metal carrier was degreased (1), a release layer was formed (2), copper particles were formed by electroless copper plating (3), and copper electroplating was performed (4) in the same manner as in Example 1-1. Subsequently, an epoxy resin, an acrylic resin or a mixture thereof in a predetermined ratio was coated and cured on the metal carrier. The aluminum carrier was peeled off. Thereafter, the porous copper thin layer was removed from the cured resin by etching to manufacture a polymer sheet formed with irregularities such as concave surfaces.

Evaluation Example 1 (Measurement of Pore Sizes of the Porous Copper Foils)

The cross-sections of the porous copper foils produced in Examples 1-1, 1-2, and 1-3 were observed under an electron microscope. The mean pore diameter of each porous copper foil was measured by averaging the diameters of 30 pores in the central portion of the micrograph. As can be seen from the results in Table 1, the pore size decreased with increasing electroless copper plating time.

TABLE 1

| | Example 1-1 | Example 1-2 | Example 1-3 |
|---|---|---|---|
| Mean pore diameter (μm) | 28.6 | 10.3 | 3.3 |

Although the spirit of the present invention has been described herein with reference to the foregoing embodiments, those skilled in the art will appreciate that various changes and modifications are possible, without departing from the essential features of the present invention. Therefore, the embodiments do not serve to limit the spirit of the invention and are set forth for illustrative purposes. The scope of the invention is defined by the appended claims and all changes or modifications or their equivalents made within the meanings and scope of the claims should be construed as falling within the scope of the invention.

What is claimed is:

1. A method for producing a porous copper foil, comprising:

forming a release layer on a metal carrier, wherein the metal carrier is made of aluminum with a natural surface oxide film and the release layer is composed of a metal compound having a thickness of 10 nanometers or less;

growing copper islands on the metal carrier formed with the release layer by electroless copper plating;

forming a porous copper thin layer by copper electroplating using the metal carrier with the natural surface oxide film as an electrode to electroplate only the copper islands; and peeling off the porous copper thin layer from the release layer.

2. The method according to claim 1, wherein the porous copper thin layer has a thickness of 1 to 5 microns and comprises pores having a size of 1 to 30 microns.

3. A method for manufacturing a polymer resin sheet with surface irregularities, comprising:

forming a release layer on a metal carrier, wherein the metal carrier is made of aluminum with a natural surface oxide film and the release layer is composed of a metal compound layer having a thickness of 10 nanometers or less;

growing copper islands on the metal carrier formed with the release layer by electroless copper plating;

forming a porous copper thin layer by copper electroplating using the metal carrier with the natural surface oxide film as an electrode to electroplate only the copper islands;

applying a curable polymer onto the porous copper thin layer and curing the curable polymer;

peeling off the cured polymer and the porous copper thin layer from the release layer; and removing the copper from the cured polymer and the porous copper thin layer.

* * * * *